US009416578B2

(12) United States Patent
Nakamae

(10) Patent No.: US 9,416,578 B2
(45) Date of Patent: Aug. 16, 2016

(54) DOOR CLOSER

(71) Applicant: RYOBI LTD., Hiroshima (JP)

(72) Inventor: Tomohiro Nakamae, Hiroshima (JP)

(73) Assignee: RYOBI LTD., Hiroshima (JP)

( * ) Notice: Subject to any disclaimer, the term of this patent is extended or adjusted under 35 U.S.C. 154(b) by 0 days.

(21) Appl. No.: 14/760,164

(22) PCT Filed: Nov. 5, 2013

(86) PCT No.: PCT/JP2013/079869

§ 371 (c)(1),
(2) Date: Jul. 9, 2015

(87) PCT Pub. No.: WO2014/136317

PCT Pub. Date: Sep. 12, 2014

(65) Prior Publication Data

US 2015/0345202 A1 Dec. 3, 2015

(30) Foreign Application Priority Data

Mar. 4, 2013 (JP) ..... 2013-041651
Mar. 15, 2013 (JP) ..... 2013-052802
Sep. 11, 2013 (JP) ..... 2013-188389

(51) Int. Cl.
*E05F 1/00* (2006.01)
*E05F 3/10* (2006.01)
(Continued)

(52) U.S. Cl.
CPC ... *E05F 3/10* (2013.01); *E05F 1/08* (2013.01); *E05F 1/105* (2013.01); *E05F 3/104* (2013.01); *E05F 3/225* (2013.01); *E05Y 2201/492* (2013.01); *Y10T 16/2766* (2015.01)

(58) Field of Classification Search
CPC ... Y10T 16/281; Y10T 16/299; Y10T 16/286; Y10T 16/27; Y10T 16/56; Y10T 16/585; Y10T 16/568; Y10T 16/2799; Y10T 16/552; Y10T 16/276; Y10T 16/2769; Y10T 16/2774; Y10T 16/2771; E05Y 2900/132; E05F 3/00; E05F 3/108; E05F 3/104; E05F 3/225; E05F 3/02; E05F 3/04; E05F 3/06; E05F 3/08; E05F 3/22; E05F 3/01; E05F 1/08; E05F 1/105; E05F 1/1016; E05F 1/1091; E05F 2003/228
See application file for complete search history.

(56) References Cited

U.S. PATENT DOCUMENTS 3,701,180 A * 10/1972 Jentsch ..... E05F 3/104 16/52
3,724,023 A * 4/1973 Tillmann ..... E05F 3/104 16/52

(Continued)

FOREIGN PATENT DOCUMENTS

EP 0407150 A1 1/1991
JP 4535631 11/1970

(Continued)

OTHER PUBLICATIONS

International Search Report dated Jan. 21, 2014 filed in PCT/JP2013/079869.

*Primary Examiner* — Chuck Mah
(74) *Attorney, Agent, or Firm* — Rankin, Hill & Clark LLP

(57) ABSTRACT

Disclosed is a door closer that can easily adjust the spring force of a return spring. A piston 2 moves toward a first oil chamber 15 upon a door opening operation and moves toward a second oil chamber 16 upon a door closing operation. A return spring 50 is located on the same line as the piston 2. The return spring 50 is interposed between a spring retaining seat on a fixed side close to a main shaft 3 and a spring retaining seat on a moving side distant from the main shaft 3. The return spring 50 is compressed by the spring retaining seat on the moving side moving closer to the spring retaining seat on the fixed side upon the door opening operation and then stores the closing force. The door closer includes a spring force adjustment mechanism configured to change the position of a spring retaining member 40, which has the spring retaining seat on the fixed side, in the axial direction of the piston 2 with respect to the main body housing 1, and configured to adjust the spring force of the return spring 50 by changing the position of the spring retaining member 40 through an operation from the outside of the main body housing 1.

7 Claims, 11 Drawing Sheets

(51) Int. Cl.

| | |
|---|---|
| ***E05F 1/08*** | (2006.01) |
| ***E05F 3/22*** | (2006.01) |
| ***E05F 1/10*** | (2006.01) |

(56) References Cited

U.S. PATENT DOCUMENTS

| | | | | | |
|---|---|---|---|---|---|
| 3,742,553 | A * | 7/1973 | Sittmann | E05F 3/221 | 16/286 |
| 3,838,477 | A * | 10/1974 | Evans | E05F 3/104 | 16/55 |
| 5,243,735 | A * | 9/1993 | O'Brien, II | E05F 3/104 | 16/49 |
| 5,337,448 | A * | 8/1994 | Brown | E05F 3/104 | 16/284 |
| 5,417,013 | A * | 5/1995 | Tillmann | E05F 3/104 | 16/53 |
| 5,666,692 | A * | 9/1997 | Toledo | E05F 3/104 | 16/51 |
| 5,802,670 | A * | 9/1998 | Bienek | E05F 3/10 | 16/53 |
| 5,901,412 | A * | 5/1999 | Jentsch | E05F 3/104 | 16/53 |
| 6,260,236 | B1 * | 7/2001 | Toledo | E05F 3/104 | 137/904 |
| 2007/0256275 | A1 * | 11/2007 | Winkler | E05F 3/104 | 16/53 |
| 2008/0034535 | A1 * | 2/2008 | Chiang | E05F 3/104 | 16/60 |

FOREIGN PATENT DOCUMENTS

| | | |
|---|---|---|
| JP | 755254 | 12/1995 |
| JP | 2012241439 A2 | 12/2012 |

* cited by examiner

DOOR CLOSER

TECHNICAL FIELD

The present invention relates to a door closer.

BACKGROUND ART

As a type of door closer, a floor hinge embedded in a floor is disclosed in Patent Literature 1. The floor hinge proposed by the present applicant in Patent Literature 1 is configured to include a spring retaining seat on a fixed side, a return spring, and a piston in this order from the side closest to a main shaft. In other words, the floor hinge is configured such that the return spring is interposed between the piston and the spring retaining seat on the fixed side and an end surface of the piston on the main shaft side serves as a spring retaining seat on a moving side. The piston moves toward the spring retaining seat on the fixed side when a door is opened, and accordingly, the return spring is compressed to store the closing force. The floor hinge is configured to use the closing force (spring force) of the return spring to rotate the main shaft and automatically close the door.

CITATION LIST

Patent Literature

Patent Literature 1: JP-UM-B-7-55254

SUMMARY OF THE INVENTION

Problems to be Solved by the Invention

However, in the floor hinge configured in this manner, the spring force of the return spring cannot be adjusted from the outside of a main body housing without disassembly. Accordingly, depending on the relationship with the size or weight of the door, an excessively large force may be required to open the door, or the door may not be fully dosed.

Solutions to the Problems

The present invention has been made to solve the above problems. A door closer according to the present invention includes: a main shaft that rotates upon a door opening/closing operation; a main body housing that pivotally supports the main shaft and includes an oil chamber filled with hydraulic oil; a piston that partitions the oil chamber into a first oil chamber on a side close to the main shaft and a second oil chamber on a side opposite to the main shaft, and moves toward the first oil chamber upon the door opening operation and moves toward the second oil chamber upon the door closing operation; a piston drive section that converts a rotation movement of the main shaft into a linear movement to drive the piston; and a return spring located on an identical line to the piston and interposed between a spring retaining seat on a fixed side close to the main shaft and a spring retaining seat on a moving side distant from the main shaft, the return spring storing a closing force upon being compressed by the spring retaining seat on the moving side moving closer to the spring retaining seat on the fixed side upon the door opening operation, and the door closer further includes a spring force adjustment mechanism configured to change a position of a spring retaining member having the spring retaining seat on the fixed side in an axial direction of the piston with respect to the main body housing, and configured to adjust a spring force of the return spring by a change of the position of the spring retaining member through an operation from an outside of the main body housing.

In the door closer with such configuration, the piston moves toward the second oil chamber upon the door closing operation. Accordingly, the pressure in the first oil chamber is not increased upon the door closing operation. Therefore, there is no concern that hydraulic oil is leaked from a bearing portion of the main shaft due to an increase in pressure of the first oil chamber. The door closer includes the spring force adjustment mechanism configured to change the position of the spring retaining member with respect to the main body housing. Thus, by operating the spring force adjustment mechanism from the outside of the main body housing, the position of the spring retaining member can be changed and the spring force of the return spring can be easily adjusted.

Specifically, it is preferable that the piston is located between the spring retaining member and the main shaft, the piston and the spring retaining seat on the moving side are connected by a connecting rod penetrating the spring retaining member, the connecting rod has a tubular portion opening at an end on the opposite side to the piston, and the spring force adjustment mechanism includes: an operation section provided to an end of the main body housing on a side close to the second oil chamber; and a transmission section that transmits a movement of the operation section to the spring retaining member through an inside of the tubular portion of the connecting rod to move the spring retaining member in the axial direction of the piston.

In the configuration where the piston is located between the spring retaining member and the main shaft, i.e., in the configuration where the piston is located on the side close to the main shaft with respect to the spring retaining member, the spring force adjustment mechanism can be configured easily, as compared to the configuration where the piston is located on the side opposite to the main shaft with respect to the spring retaining member. The operation section is provided to the end of the main body housing on the side close to the second oil chamber. Thus, the operation section can be easily operated. Moreover, the spring retaining member is located away from the end of the main body housing on the side close to the second oil chamber. In addition, even if the connecting rod or return spring exists in between, the transmission section uses the internal space of the tubular portion of the connecting rod to transmit the movement of the operation section. Thus, the movement of the operation section can be securely transmitted, and the increase in size of the main body housing can be prevented.

Moreover, it is preferable that a horizontal hole is formed in a peripheral wall of the tubular portion of the connecting rod, and the spring force adjustment mechanism includes: an adjustment shaft that penetrates the end of the main body housing on the side close to the second oil chamber and is inserted through the tubular portion of the connecting rod; and a coordinating member that coordinates the adjustment shaft with the spring retaining member via the horizontal hole of the connecting rod.

The adjustment shaft is inserted into the connecting rod. The coordinating member coordinates the adjustment shaft with the spring retaining member via the horizontal hole of the connecting rod. Consequently, by operating the protruding portion of the adjustment shaft, which protrudes from the end of the main body housing on the side close to the second oil chamber side, the position of the spring retaining member can be easily changed.

Furthermore, it is preferable that the connecting rod has a tubular shape over a total length, a communicating hole with a check valve communicating between the first oil chamber and the second oil chamber is formed at a center of the piston, and the communicating hole is located inside an end of the connecting rod on a side close to the piston.

The communicating hole with the check valve is formed in the piston. Accordingly, the hydraulic oil can pass from the communicating hole of the piston upon the door opening operation. Furthermore, the communicating hole can be closed by the check valve upon the door closing operation. Moreover, the connecting rod is formed into a tube shape over its total length. Accordingly, the communicating hole can be located inside the end on the piston side of the connecting rod. Therefore, the size increase of the piston and the main body housing can be prevented as compared to the configuration where the communicating hole is located outside the connecting rod. In addition, the connecting rod is formed into a tube shape up to the end on the side close to the piston. Thus, the hydraulic oil can pass from the communicating hole of the piston through the inside of the connecting rod. If the horizontal hole is formed in the connecting rod, the hydraulic oil can move easily from the inside to the outside of the connecting rod through the horizontal hole.

Furthermore, it is preferable that the spring force adjustment mechanism includes: an operation section provided to an end of the main body housing on a side close to the second oil chamber; and a transmission section that transmits a movement of the operation section to the spring retaining member to move the spring retaining member in the axial direction of the piston, the transmission section is provided with a flange portion that is rotated by an operation of the operation section, and a rolling element holding plate that holds a plurality of rolling elements rolling by rotation of the flange portion is arranged in the main body housing.

The flange portion provided to the transmission section rotates while rolling the plurality of rolling elements held by the rolling element holding plate. Thus, operability upon adjustment of the spring force can be improved.

Furthermore, it is preferable that a recess is formed in the main body housing, and an expansion absorption member is accommodated in the recess to come into contact with hydraulic oil in the first oil chamber.

The expansion absorption member accommodated in the recess is in contact with the hydraulic oil in the first oil chamber. Thus, the hydraulic oil, which has expanded due to an increase in temperature, can be prevented from leaking from the main body housing.

Furthermore, it is preferable that the door closer includes pullout prevention means that prevents the expansion absorption member from coming out of the recess.

By virtue of the pullout prevention means, the expansion absorption member can be prevented from coming out of the recess.

Effects of the Invention

As described above, in the door closer according to the present invention, the position of the spring retaining member having the spring retaining seat on the fixed side can be changed by the spring force adjustment mechanism from the outside of the main body housing. Thus, the spring force of the return spring can be easily adjusted in accordance with the size and weight of a door.

BRIEF DESCRIPTION OF HIE DRAWINGS

DESCRIPTION OF EMBODIMENTS

Figure 1:
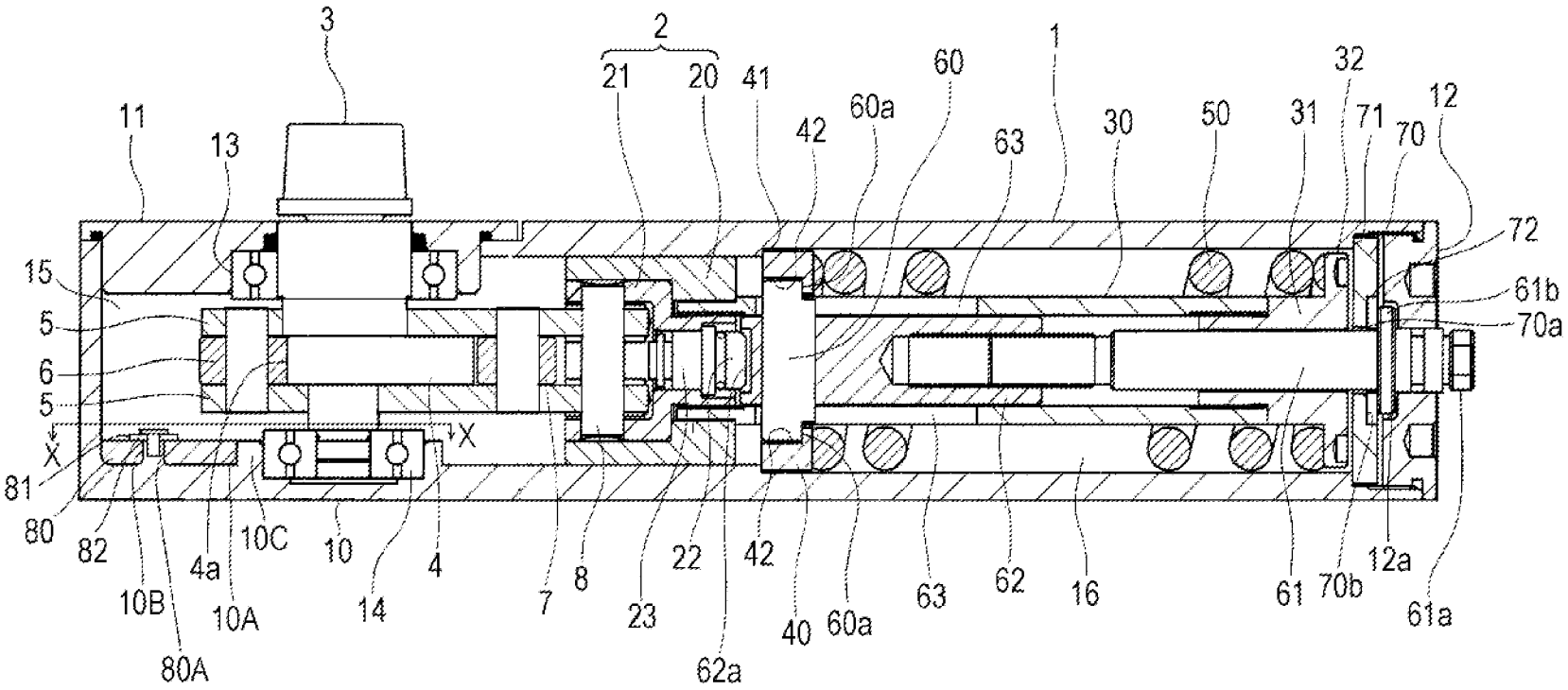
FIG. 1 is a cross-sectional view of a floor hinge as a door closer according to an embodiment of the present invention in frontal view, and illustrates a door closed state where a spring force is its minimum.
Figure 2:
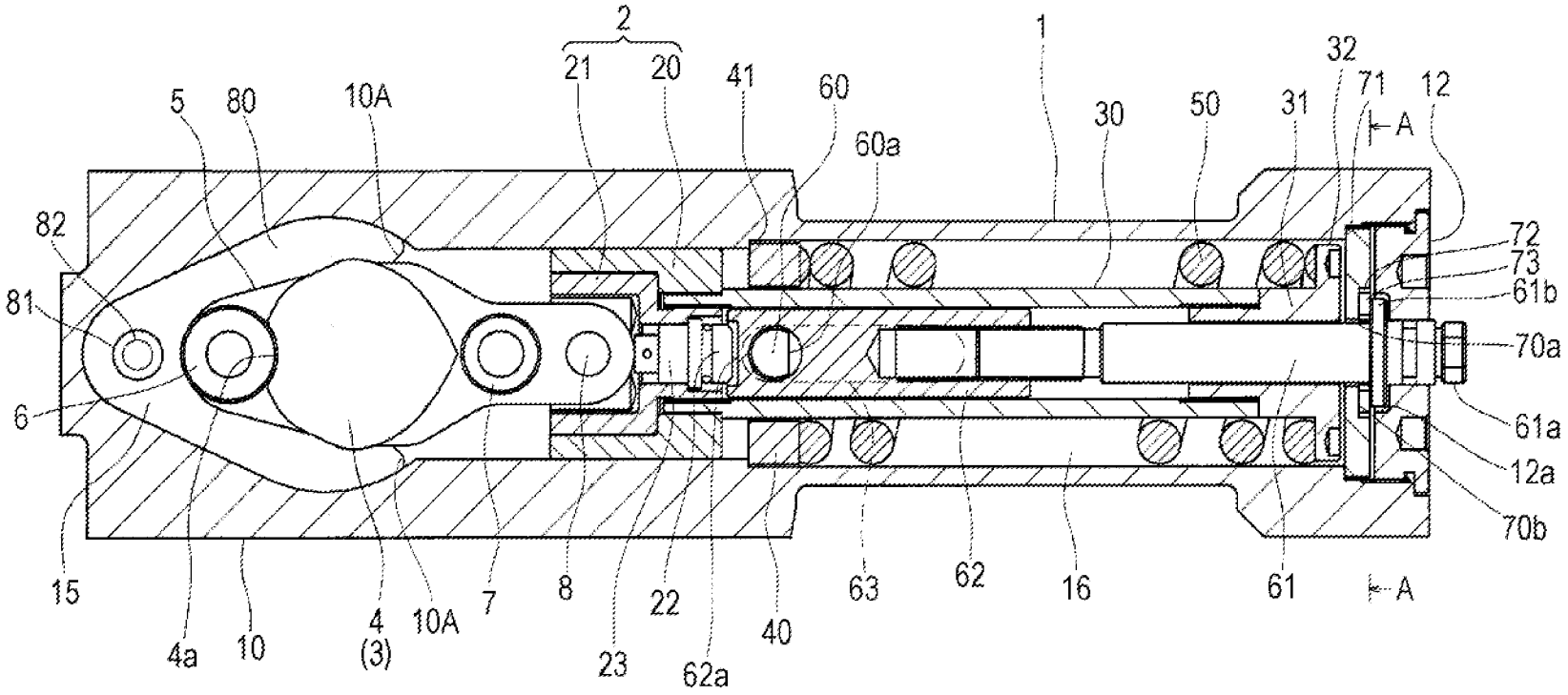
FIG. 2 is a cross-sectional view of the floor hinge in planar view, and illustrates the door closed state where the spring force is its minimum.

Hereinafter, a floor hinge as a door closer according to one embodiment of the present invention will be described with reference to FIGS. 1 to 12. The floor hinge in the embodiment includes a main body housing 1 that forms an oil chamber where hydraulic oil is filled. As illustrated in FIG. 1, the thickness of the main body housing 1 in the vertical direction is constant. The floor hinge has a shape that is long in a predetermined direction as illustrated in FIG. 2. The main body housing 1 includes a piston 2 that partitions the oil chamber into two rooms. The longitudinal direction of the main body housing 1 is coincident with an axial direction of the piston 2. Hereinafter, the axial direction indicates the axial direction of the piston 2 unless otherwise specified specifically in the description. In the drawings, the right side is termed one end side in the axial direction, and the left side is termed the other end side in the axial direction. However, the one end side in the axial direction will be simply referred to as a front side, and the other end side in the axial direction will be simply referred to as a rear side.

The main body housing 1 includes a main section 10 constituting its main part, an upper cap 11 mounted at the top on the rear side, and a horizontal cap 12 mounted at the end on the front side. The oil chamber filled with hydraulic oil is formed in the main body housing 1.

A main shaft 3 is pivotally supported in the rear of the main body housing 1. The main shaft 3 serves as the axis of rotation of a door. The main shaft 3 rotates in response to the door opening/closing operation. The center of the main shaft 3 is located on the center line (axis) of the piston 2 in planar view. The main shaft 3 is rotatably supported by the upper cap 11 and a bottom portion of the main section 10 via bearings 13 and 14. An upper portion of the main shaft 3 protrudes upwardly by a predetermined length from the upper cap 11. A heart-shaped cam 4 is provided to the main shaft 3. The cam 4 and the main shaft 3 rotate integrally. The cam 4 and the main shaft 3 may be integrally processed and formed to constitute a single member. Alternatively, the cam 4 may form a floor hinge as a separate member from the main shaft 3. In any case, the cam 4 rotates integrally with the main shaft 3 upon the door opening/closing operation, and converts the rotation operation of the main shaft 3 into linear motion in the axial direction. Accordingly, the cam 4 functions as a piston drive section that drives the piston 2. The cam 4 is a plate cam whose peripheral surface is a cam surface. Only an area within a predetermined angle of the entire periphery is a section to be used in the door opening/closing operation. In the embodiment, the peripheral surface of the cam 4 has a symmetrical shape. One area of the two 180-degree areas is the section to be used. However, the peripheral surface of the cam 4 may have an asymmetrical shape. A recess 4*a*is formed at one point in the cam surface. The recess 4*a* is formed at a position corresponding to a door closed state, i.e., when the opening degree of the door is zero degrees.

Figure 3:
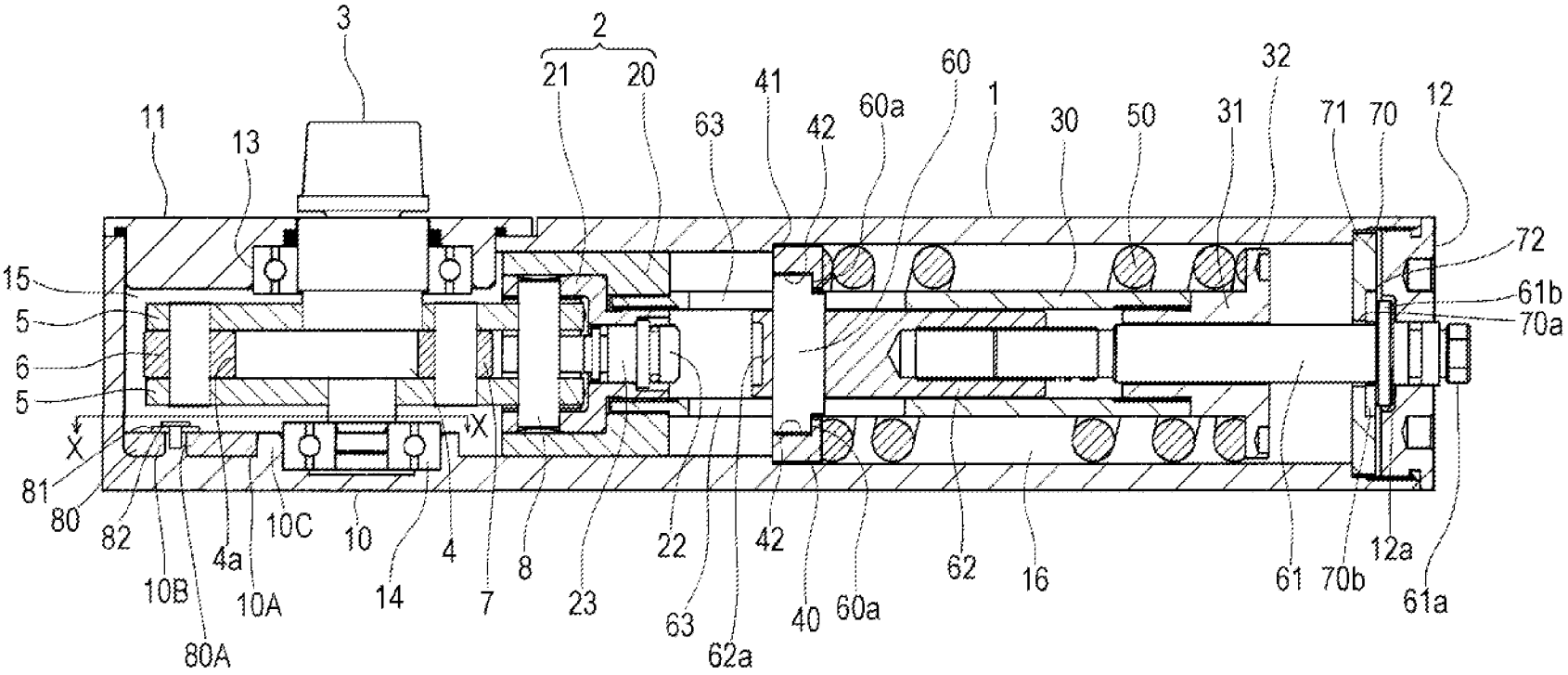
FIG. 3 is a cross-sectional view of the floor hinge in frontal view, and illustrates a state where the door is opened at 180 degrees and the spring force is its minimum.
Figure 4:
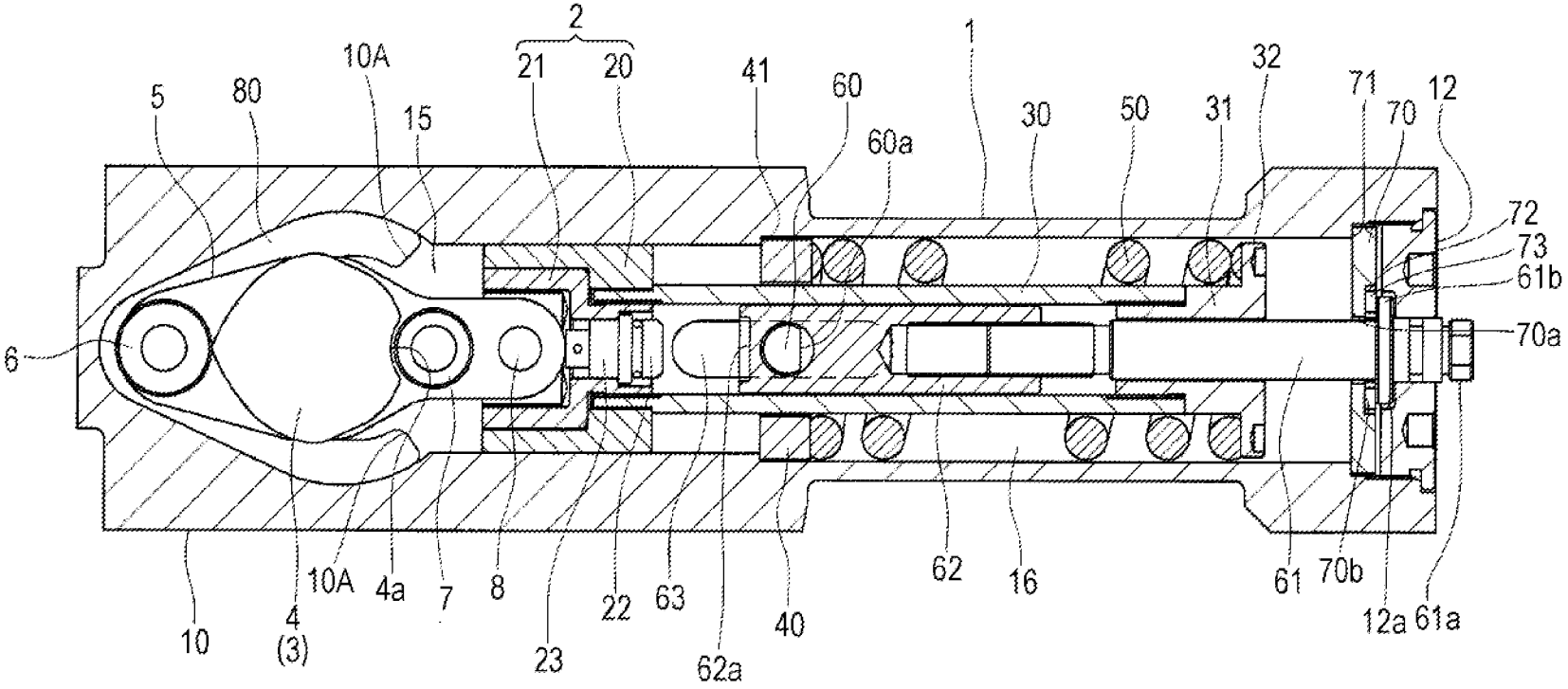
FIG. 4 is a cross-sectional view of the floor hinge in planar view, and illustrates the state where the door is opened at 180 degrees and the spring force is its minimum.

Sliding plates 5 are respectively placed above and below the cam 4. A roller 6 as a cam follower that rotates in contact with the cam 4 is provided between the sliding plates 5. A support shaft of the roller 6 is mounted to the sliding plates 5. Therefore, when the cam 4 rotates together with the main shaft 3, the sliding plates 5 move in the axial direction via the roller 6. When the cam 4 rotates 180 degrees, the states illustrated in FIGS. 1 and 2 become the states illustrated in FIGS. 3 and 4. The roller 6 is provided on the rear side of the cam 4. As illustrated in FIGS. 1 and 2, when the opening degree of the door is zero degrees, the roller 6 is engaged in the recess 4*a* of the cam 4. A roller 7 is also provided on the front side of the earn 4. The front roller 7 has a slightly smaller diameter than that of the rear roller 6. As illustrated in FIGS. 3 and 4, when the opening degree of the door reaches 180 degrees, the front roller 7 is engaged in the recess 4*a* of the cam 4 with a slight clearance therebetween. Moreover, front ends of the sliding plates 5 are inserted into a recess formed in a rear end surface of the piston 2. A pin 8 penetrating the sliding plates 5 vertically connects the sliding plates 5 and the piston 2.

The piston 2 partitions the oil chamber into a first oil chamber 15 on the main shaft 3 side, i.e., on the rear side, and a second oil chamber 16 on the opposite side to the main shaft 3, i.e., on the front side. The piston 2 moves toward the first oil chamber 15 side, i.e., the rear side, upon the door opening operation, and moves toward the second oil chamber 16 side, i.e., the front side, upon the door closing operation. The piston 2 includes a tubular outer cylinder 20 and a tubular inner cylinder 21 press-fitted and integrated into the outer cylinder 20. The inner cylinder 21 is formed to have a small diameter portion on the front side and a large diameter portion on the rear side. The inside of the large diameter portion serves as the recess. The sliding plates 5 are inserted therein.

Figure 5A:
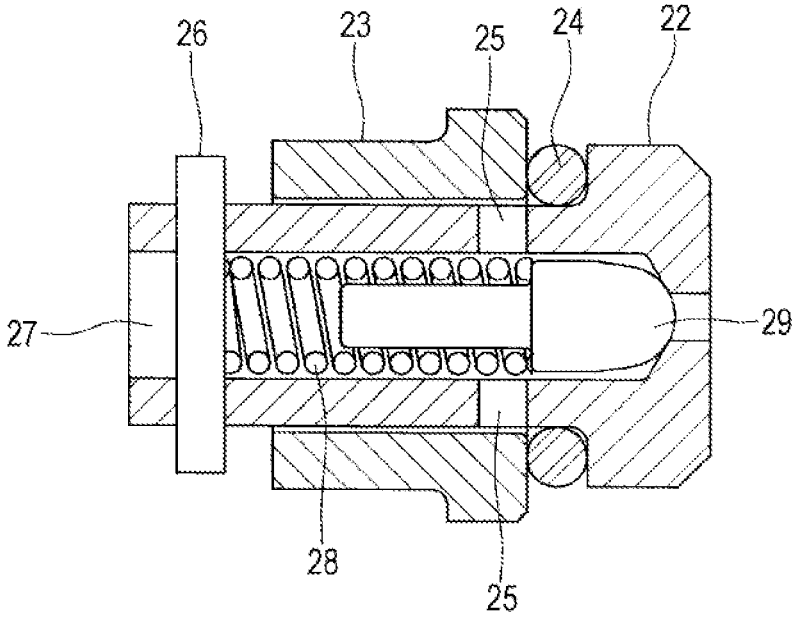
FIG. 5 is a cross-sectional views of a main part of the floor hinge, in which FIG. 5(*a*) illustrates a state where a check valve is closed upon a door closing operation and FIG. 5(*b*) illustrates a state where the check valve is opened upon a door opening operation.
Figure 5B:
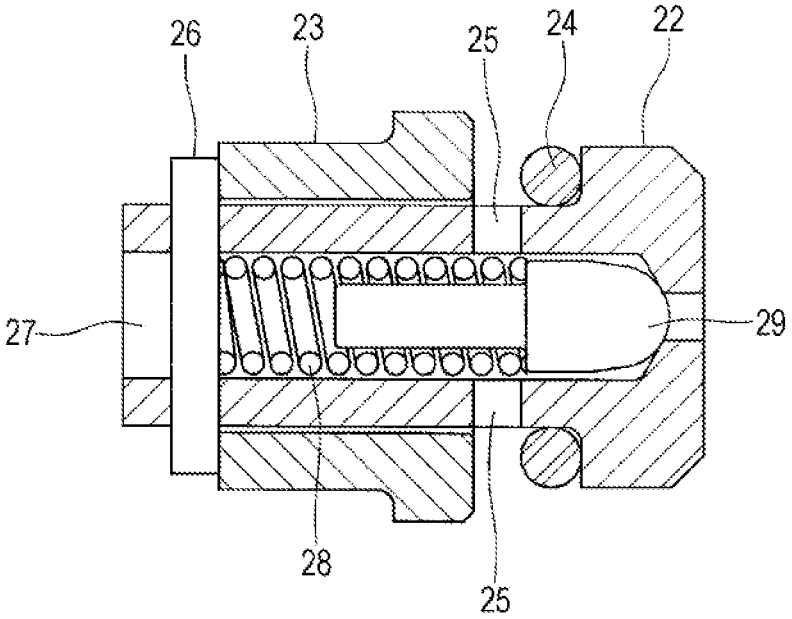

Moreover, a check valve 22 is provided inside the small diameter portion of the inner cylinder 21. Specifically, as illustrated in cross section of FIG. 6, a tubular valve seat 23 is inserted and fixed inside the small diameter portion of the inner cylinder 21. The check valve 22 is inserted in the valve seat 23 to be movable in the axial direction. Incidentally, in FIG. 6, an adjustment shaft and a spring retaining member 40, which are described below, are omitted. FIG. 5 is a cross-sectional view of only the valve seat 23 and the check valve 22. Upon the door closing operation where the piston 2 moves toward the front side, the check valve 22 is in a state of having received the hydraulic pressure on the second oil chamber 16 side and moved relatively toward the rear side with respect to the valve seat 23 as illustrated in FIG. 5(*a*). An O-ring 24 is in contact with a front end surface of the valve seat 23. Accordingly, a side hole 25 is closed. Upon the door opening operation where the piston 2 moves toward the rear side, the check valve 22 is in a state of having received the hydraulic pressure on the first oil chamber 15 side and moved relatively toward the front side with respect to the valve seat 23 as illustrated in FIG. 5(*b*). A stopper pin 26 of the check valve 22 comes into contact with a rear end surface of the valve seat 23. The O-ring 24 moves away from the front end surface of the valve seat 23 toward the front side. Accordingly, the side hole 25 is opened. The hydraulic oil on the first oil chamber 15 side can flow from an inner path 27 of the cheek valve 22 through the side hole 25 to the second oil chamber 16 side. In other words, the inner path 27 of the check valve 22 and the side hole 25 constitute a communicating hole that communicates between the first oil chamber 15 and the second oil chamber 16. The inner path 27 of the check valve 22 opens into not only a rear end surface but also a front end surface of the check valve 22. However, the front opening is normally closed with a safety valve 29 pressed and biased toward the front side by a spring 28. When the door is forced to be closed by an external force and the hydraulic pressure on the second oil chamber 16 side increases suddenly, the increased hydraulic pressure of the second oil chamber 16 causes the safety valve 29 to move toward the rear side while compressing the spring 28 against the biasing force of the spring 28. Consequently the front opening of the inner path 27 opens.

Figure 6:
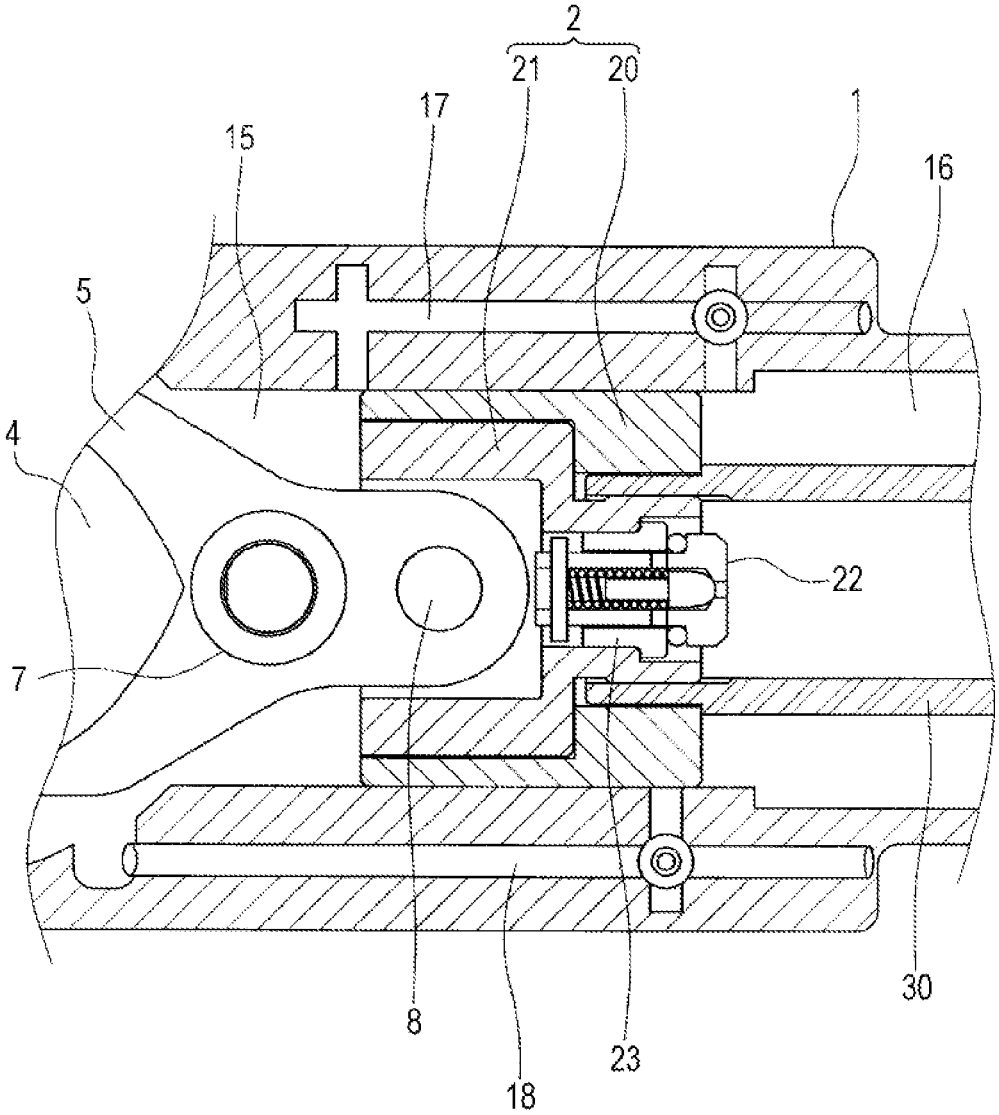
FIG. 6 is a cross-sectional view of the main part of the floor hinge in planar view.
Figure 7:
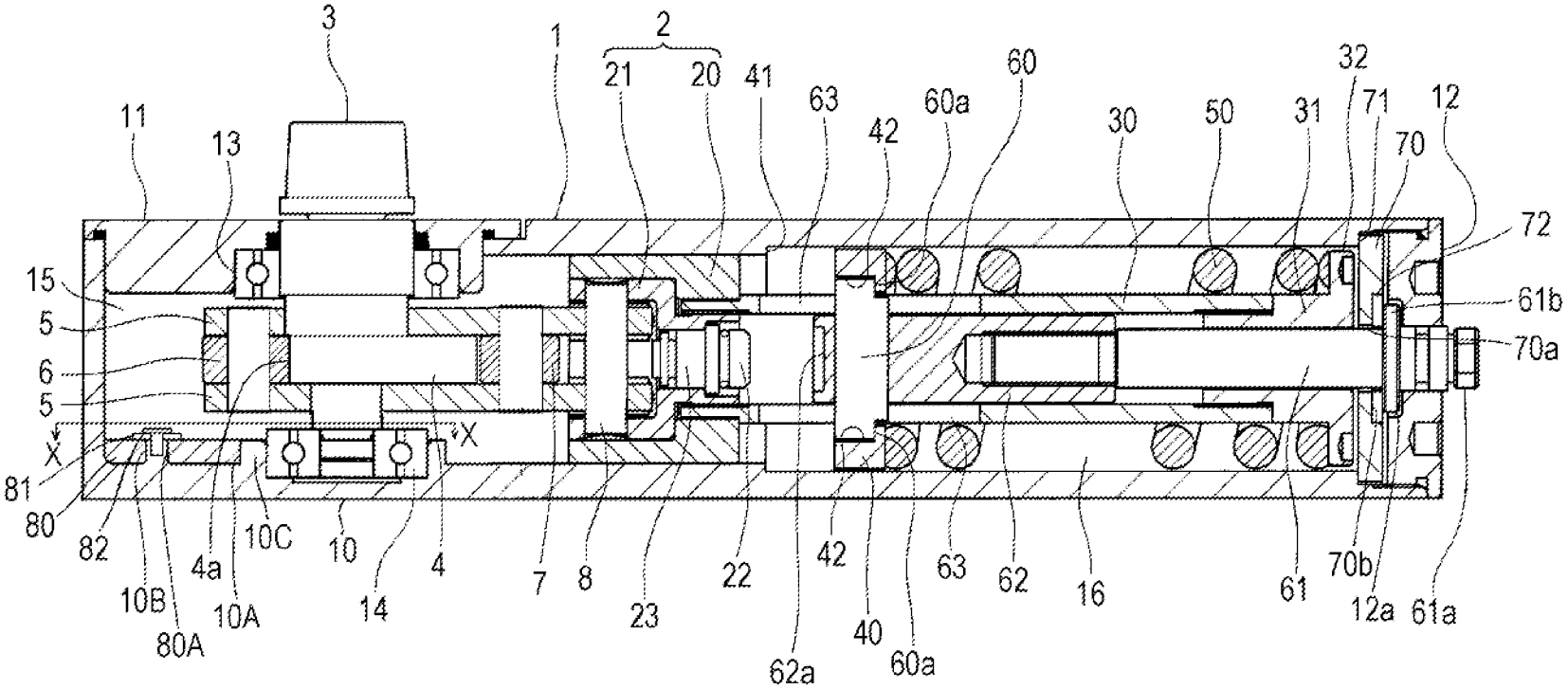
FIG. 7 is a cross-sectional view of the floor hinge in frontal view, and illustrates a door closed state where the spring force is its maximum.
Figure 8:
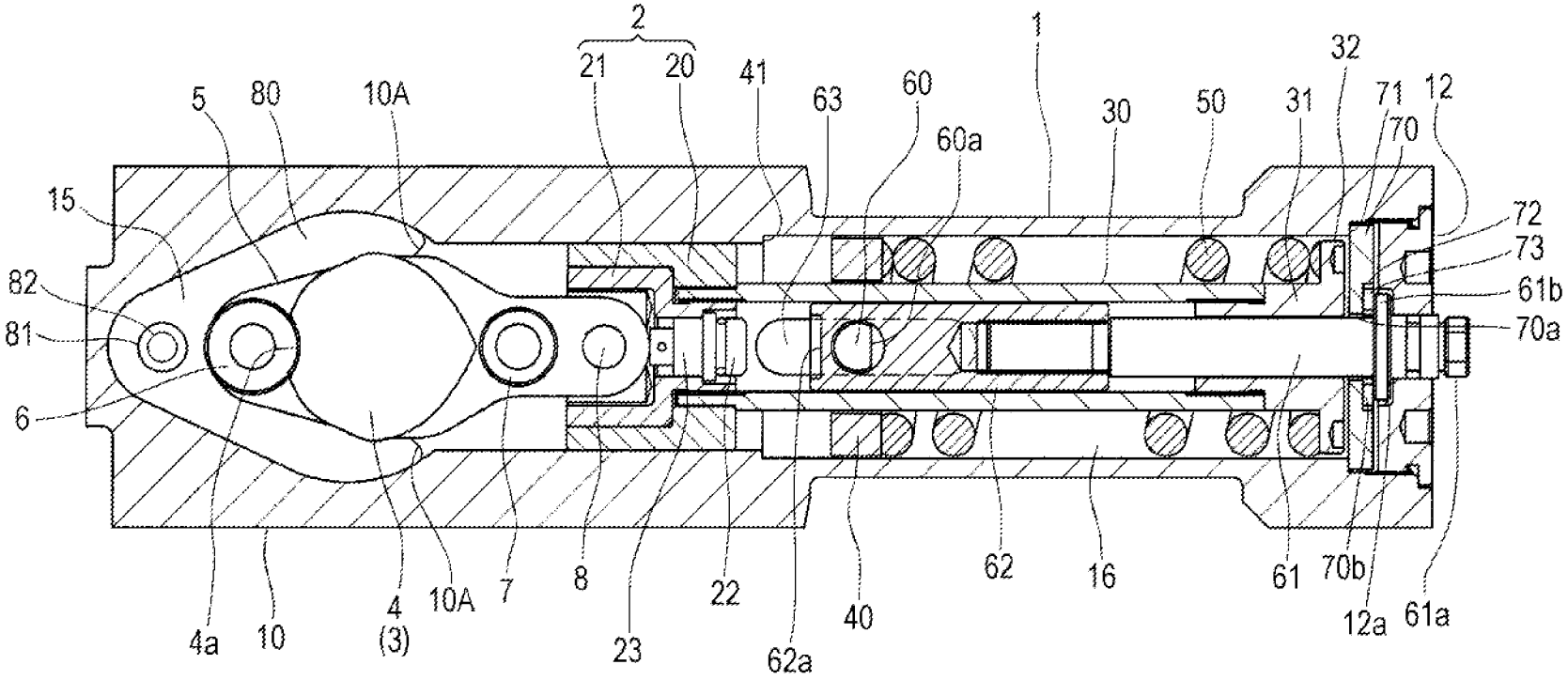
FIG. 8 is a cross-sectional view of the floor hinge in planar view, and illustrates the door closed state where the spring force is its maximum.
Figure 9:
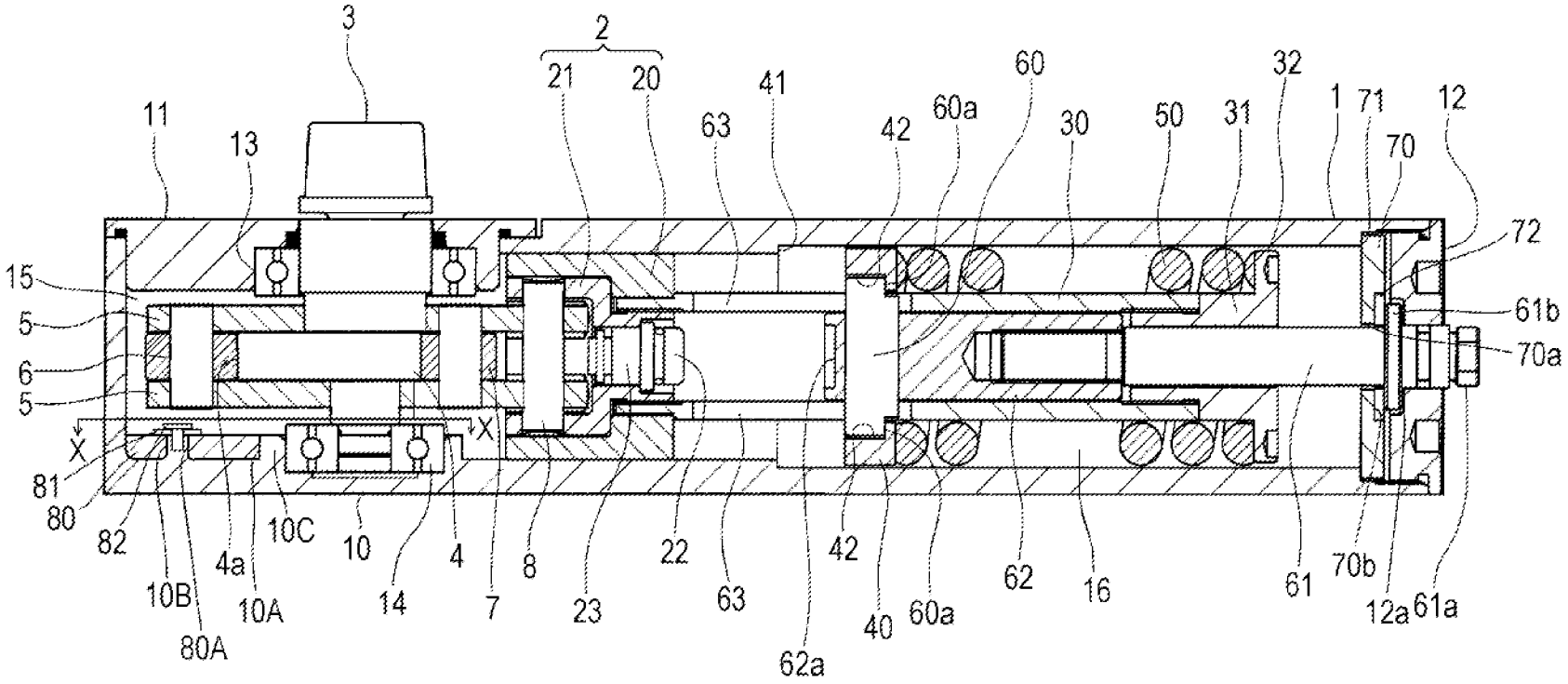
FIG. 9 is a cross-sectional view of the floor hinge in frontal view, and illustrates a state where the door is opened at 180 degrees and the spring force is its maximum.
Figure 10:
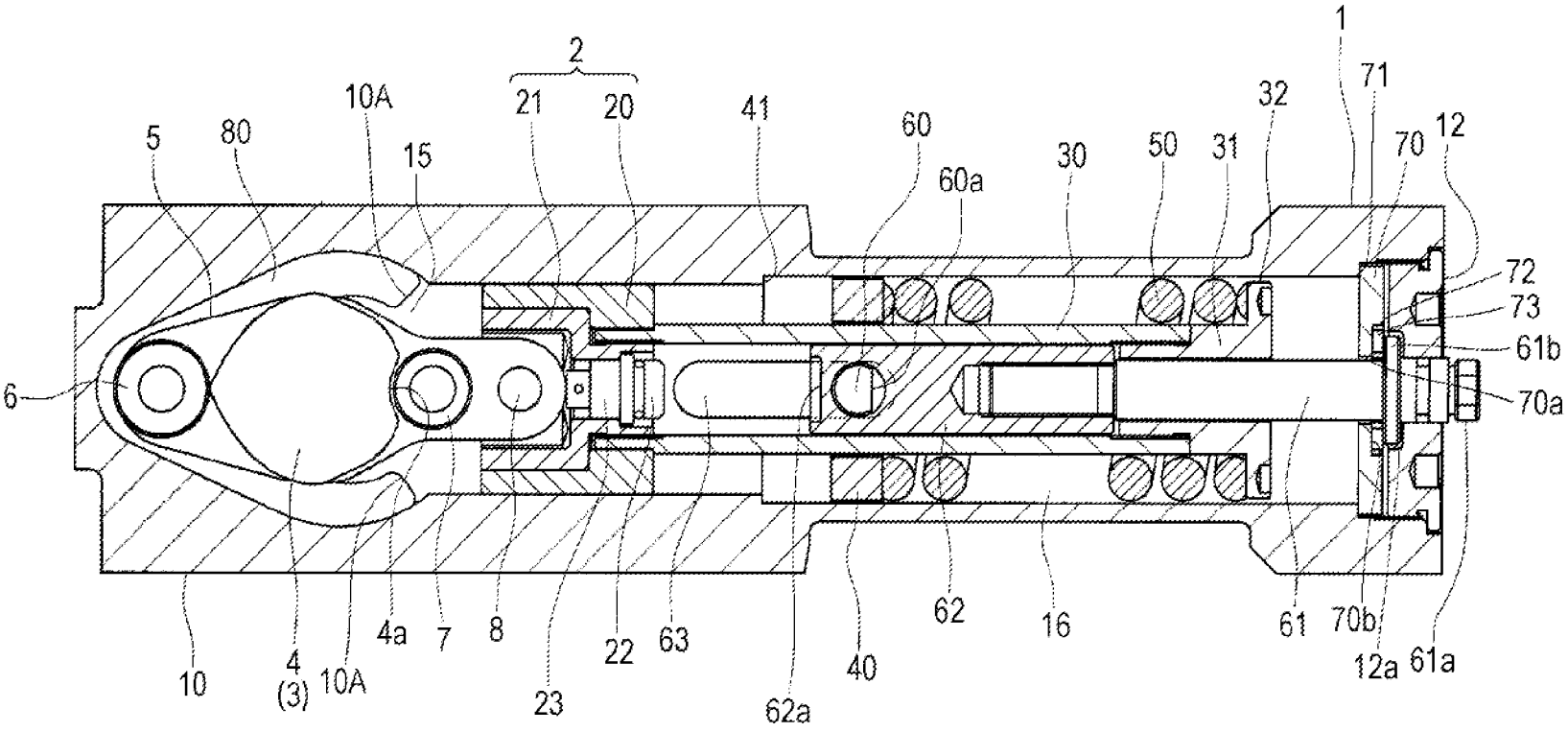
FIG. 10 is a cross-sectional view of the floor hinge in planar view, and illustrates the state where the door is opened at 180 degrees and the spring force is its maximum.

As illustrated in FIG. 6, flow control channels 17 and 18 are respectively formed in both side wall portions of the main body housing 1. The first oil chamber 15 communicates with the second oil chamber 16 through the flow control channels 17 and 18 by bypassing the piston 2. In FIG. 6, the door is fully closed. In this state, both openings on the first oil chamber 15 side and the second oil chamber 16 side of the first flow control channel 17 provided in one side wall portion illustrated on the upper side of FIG. 6 are not closed by the piston 2, and are opened. In contrast, an opening on the first oil chamber 15 side of the second flow control channel 18 provided in the other side wall portion illustrated on the lower side of FIG. 6 is opened, but an opening on the second oil chamber 16 side of the second flow control channel 18 is closed by the piston 2. When the door starts opening and the piston 2 starts moving toward the rear side, the check valve 22 opens and the hydraulic oil moves from the first oil chamber 15 through the communicating hole of the piston 2 to the second oil chamber 16. In addition, the hydraulic oil flows from the first flow control channel 17 to the second oil chamber 16 until the opening on the first oil chamber 15 side of the first flow control channel 17 is closed by the piston 2. At the timing when the piston 2 closes the opening on the first oil chamber 15 side of the first flow control channel 17, the opening on the second oil chamber 16 side of the second flow control channel 18 opens. Then, the hydraulic oil flows from the second flow control channel 18 to the second oil chamber 16. Upon the door closing operation, conversely, the check valve 22 is closed so that the hydraulic oil cannot pass through the communicating hole of the piston 2. However, from the beginning to the middle of the door closing operation, the hydraulic oil flows to the first oil chamber 15 through the second flow control channel 18. In the late stage of the door closing operation, when the piston 2 closes the second flow control channel 18, the hydraulic oil flows from the first flow control channel 17 to the first oil chamber 15. Incidentally, the flow control channels 17 and 18 are provided with an unillustrated regulating valve for controlling the amount of flow of hydraulic oil flowing therethrough.

A tubular main connecting rod 30 is connected to the piston 2. The main connecting rod 30 is connected to the front side of the piston 2 such that its axis coincides with the axis of the piston 2. The main connecting rod 30 extends from the piston 2 toward the front side. An external thread portion is formed on the small diameter portion of the inner cylinder 21 of the piston 2. A ring-shaped space is provided between the small diameter portion and the outer cylinder 20. A rear end of the main connecting rod 30 enters the space to be screwed onto the small diameter portion of the inner cylinder 21 of the piston. Therefore, the check valve 22 of the piston 2 is located inside the rear end of the main connecting rod 30.

A tubular auxiliary connecting rod 31 is connected to the front side of the main connecting rod 30. The auxiliary connecting rod 31 is screwed in an internal thread portion on an inner peripheral surface of a front end of the main connecting rod 30. Moreover, a ring-shaped flange portion 32 is formed at a front end of the auxiliary connecting rod 31. A rear end surface of the flange portion 32 forms a spring retaining seat on the moving side. Moreover, the main connecting rod 30 and the auxiliary connecting rod 31 constitute a connecting rod that connects the piston 2 and the spring retaining seat on the moving side.

The spring retaining member 40 is located on the front side of the piston 2 at a position a predetermined distance away from the piston 2 in the door closed state. A return spring 50 made of a coil spring is located on the front side of the spring retaining member 40. The spring retaining member 40 has a disc shape with a through hole in the center. The main connecting rod 30 penetrates through the spring retaining member 40. A front end surface of the spring retaining member 40 forms a spring retaining seat on the fixed side. In other words, the return spring 50 is interposed between the spring retaining member 40 and the flange portion 32 of the auxiliary connecting rod 31. The connecting rod is inserted in the return spring 50. Accordingly, the spring retaining member 40 is always pressed and biased toward the rear by the return spring 50, and the auxiliary connecting rod 31 is always pressed and biased toward the front by the return spring 50. The biasing force acting on the auxiliary connecting rod 31 is transmitted from the main connecting rod 30 to the piston 2, the sliding plates 5, and the cam 4. Therefore, upon the door opening operation, the piston 2 and the connecting rod move toward the rear side to compress the return spring 50 as illustrated in FIGS. 3 and 4. The return spring 50 stores the closing force. Then, upon the door closing operation, the closing force of the return spring 50 moves the piston 2 and the connecting rod toward the front side.

In addition, the floor hinge is formed using the spring retaining member 40 as a separate member from the main body housing 1. The floor hinge is formed such that the spring retaining member 40 is slidable in the axial direction with respect to the main body housing 1. In FIGS. 1 to 4, the spring retaining member 40 is located at its rearmost position. An outer edge of a rear end surface of the spring retaining member 40 comes into contact with a stepped portion 41 on an inner wall surface of the main body housing 1, which prevents any further rearward movement of the spring retaining member 40.

Next, a description will be given of a spring force adjustment mechanism that changes the position of the spring retaining member 40 by an operation from the outside of the main body housing 1 to adjust the spring force of the return spring 50. In FIGS. 1 to 4, the spring retaining member 40 is located at its rearmost position, and accordingly, the return spring 50 has the smallest spring force. In FIGS. 7 to 10, the spring retaining member 40 is located at its frontmost position, and accordingly, the compression amount of the return spring 50 in the door closed state is the maximum. In other words, the return spring 50 has the largest spring force.

The spring force adjustment mechanism includes the adjustment shaft and a coordinating pin 60 as a coordinating member. The adjustment shaft is on the same axis as those of the piston 2, the return spring 50, and the connecting rod. The adjustment shaft includes a first adjustment shaft 61 and a second adjustment shaft 62. The first adjustment shaft 61 penetrates the center of the horizontal cap 12 in the axial direction. A front end portion 61*a* of the first adjustment shaft 61 protrudes from the horizontal cap 12 toward the front side. The front end portion 61*a* of the first adjustment shaft 61, which protrudes from the horizontal cap 12, serves as an operation section. This portion is rotated to operate the adjustment shaft. Moreover, the first adjustment shaft 61 includes a flange portion 61*b*, almost all of which is accommodated in a recess 12*a* formed on the rear end surface side of the horizontal cap 12. The flange portion 61*b* is accommodated in the recess 12*a* of the horizontal cap 12 such that its front end surface and side surfaces do not come into contact with the horizontal cap 12.

Figure 11:
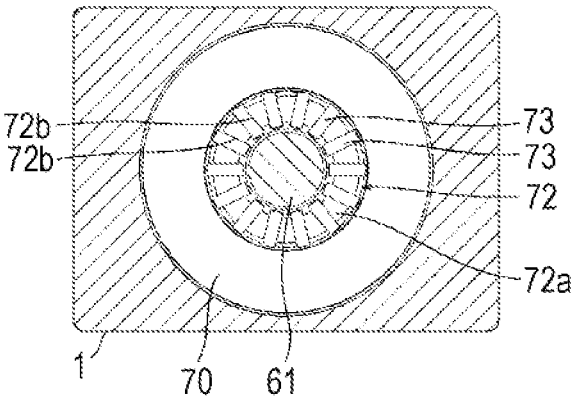
FIG. 11 is a cross-sectional view taken along line A-A of FIG. 2.

A disc-shaped rolling element holding plate 70 is placed in the second oil chamber 16 by being fitted into the main body housing 1 through a hole portion for mounting the horizontal cap 12. An outer edge of a rear end surface of the rolling element holding plate 70 is in contact with a stepped portion 71 on the inner wall surface of the main body housing 1. Consequently, the position of the rolling element holding plate 70 is determined in the second oil chamber 16. A hole 70*a* is formed at the center of the rolling element holding plate 70. The first adjustment shaft 61 penetrates through the hole 70*a*. Moreover, a groove portion 70*b* is formed in a front end surface of the rolling element holding plate 70. A cage 72 that rollably holds a plurality of needle rollers 73 is fitted and accommodated in the groove portion 70*b*. As illustrated in FIG. 11, the cage 72 holds a ring-shaped main body 72*a* and the needle rollers 73 as rolling elements. Thus, the cage 72 includes a plurality of pockets 72*b* formed in the circumferential direction of the ring-shaped main body 72*a*. The first adjustment shaft 61 penetrates the center of the cage 72. An outer edge of a rear end surface of the flange portion 61*b* of the first adjustment shaft 61 is in contact with the plurality of needle rollers 73 that is held by the rolling element holding plate 70 and rolls. Consequently, the movement of the piston 2 in the axial direction by the first adjustment shaft 61 is regulated. The plurality of needle rollers 73 is also in contact with a bottom of the groove portion 70*b* of the rolling element 70. The plurality of needle rollers 73 rolls between the flange portion 61*b* of the first adjustment shaft 61 and the rolling element holding plate 70. In other words, by rotating the front end portion 61*a* of the first adjustment shaft 61, the flange portion 61*b* of the first adjustment shaft 61 rotates while rolling the plurality of needle rollers 73 held by the rolling element holding plate 70.

The first adjustment shaft 61 is inserted in the connecting rod. An external thread portion is formed on an outer peripheral surface of a rear end of the first adjustment shaft 61. The external thread portion is screwed in an internal thread portion formed in an inner peripheral surface of a front end of the second adjustment shaft 62. The entirety of the second adjustment shaft 62 is inserted in the connecting rod, specifically, in the main connecting rod 30. By rotating the first adjustment shaft 61, the second adjustment shaft 62 slides in the axial direction by virtue of the screw feeding mechanism.

The coordinating pin 60 is mounted and fixed to the rear of the second adjustment shaft 62. The coordinating pin 60 has a vertical axis and penetrates the second adjustment shaft 62 vertically. A horizontal hole 63 having a long hole shape that is long in the axial direction is formed in each of the upper and lower parts of a peripheral wall of the main connecting rod 30. Upper and lower ends of the coordinating pin 60 are inserted through the horizontal holes 63, and extend upwardly and downwardly. A pair of upper and lower engagement recesses 42 is formed in an inner peripheral surface of the spring retaining member 40. The upper and lower ends of the coordinating pin 60 are respectively engaged in the engagement recesses 42. A flat surface 60*a* is formed on each of front portions of the upper and lower ends of the coordinating pin 60. A flat surface is formed, corresponding to the flat surface 60*a*, also on a front portion of a wall surface of the engagement recess 42 of the spring retaining member 40. Therefore, the coordinating pin 60 and the spring retaining member 40 are in a relationship where their flat surfaces are in contact with each other. The flat surface 60*a* of the coordinating pin 60 moves the spring retaining member 40 in the axial direction while pressing the flat surface of the spring retaining member 40 toward the front side. In this manner, in the embodiment, the front end portion 61*a* of the first adjustment shaft 61, which protrudes from the horizontal cap 12, serves as the operation section that is rotated and operated. The rotation of the first adjustment shaft 61 is converted into the movement of the second adjustment shaft 62 in the axial direction by virtue of the screw feeding mechanism. In this manner, the rotation of the first adjustment shaft 61 is transmitted by the coordinating pin 60 to spring retaining member 40 through the horizontal holes 63 of the main connecting rod 30. In the embodiment, the first adjustment shaft 61, the second adjustment shaft 62, and the coordinating pin 60 constitute a transmission section that transmits the movement of the operation section to the spring retaining member 40.

A recess 62*a* is formed in a rear end surface of the second adjustment shaft 62. As illustrated in FIGS. 1 and 2, a front end portion of the check valve 22 can enter the recess 62*a* of the second adjustment shaft 62 by a predetermined amount when the piston 2 is at the position closest to the spring retaining member 40.

Figure 12:
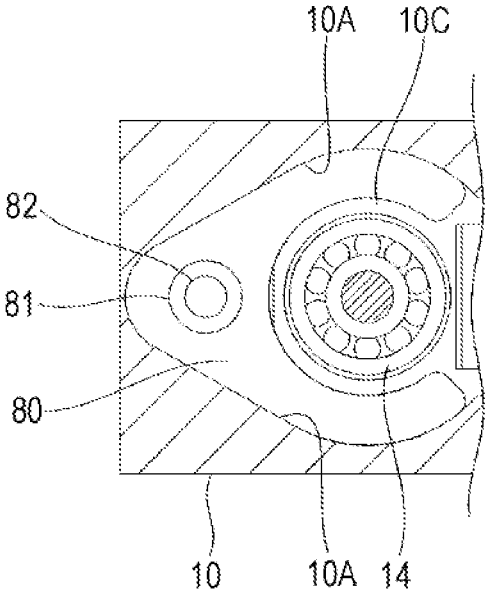
FIG. 12 is a cross-sectional view taken along line X-X of FIG. 1.

A recess 10A for accommodating a sponge rubber 80 as an expansion absorption member is formed in a portion that defines the first oil chamber 15 at the bottom of the main section 10 of the main body housing 1. As illustrated in FIG. 12, the recess 10A is a groove that is C-shaped in planar view and formed around a bearing mounting portion 10C of the main section 10. The sponge rubber 80, which is C-shaped in planar view and accommodated in the recess 10A, is in contact with hydraulic oil in the first oil chamber 15. A cylindrical boss 10B is provided in a protruding manner in the recess 10A. A through hole 80A formed in the rear of the sponge rubber 80 is inserted in the cylindrical boss 10B, and accordingly, the sponge rubber 80 is fitted in the recess 10A. A pin 82 as pullout prevention means is fitted in a hole of the cylindrical boss 10B via a washer 81. The sponge rubber 80 is prevented from coming out of the recess 10A. The sponge rubber 80 has a closed cell structure. If the hydraulic oil in the oil chamber expands due to temperature increase, air in each cell is compressed and the volume of the sponge rubber 80 is reduced. The expansion of die hydraulic oil due to die temperature increase is absorbed by the change in volume of the sponge rubber 80 accommodated in the recess 10A. Thus, an increase in internal pressure of the oil chamber and oil leakage from the main body housing 1 (for example, between the upper cap 11 and the main section 10) are prevented. The sponge rubber 80 of which the volume is reduced in the recess 10A due to the temperature increase returns to its original volume when the hydraulic oil returns to room temperature.

In the floor hinge configured as described above, the piston 2 moves toward the first oil chamber 15 side upon the door opening operation and moves toward the second oil chamber 16 side upon the door closing operation. Accordingly, the hydraulic pressure on the first oil chamber 15 side is not increased upon the door closing operation. Thus, oil leakage from an area of the bearing 13 of the main shaft 3, which is caused by an increase in pressure of the first oil chamber 15, can be suppressed. Moreover, the recess 10A is formed in the main section 10 of the main body housing 1. The sponge rubber 80 is accommodated in the recess 10A. Thus, oil is prevented from leaking from the main body housing 1 (for example, between the upper cap 11 and the main section 10) due to the expansion of the hydraulic oil caused by temperature increase. The sponge rubber 80 accommodated in the recess 10A comes into contact with hydraulic oil in the first oil chamber 15. Thus, the sponge rubber 80 does not inhibit the movement of the cam 4 and the sliding plates 5 in the first oil chamber 15. Moreover, the pin 82 securely prevents the sponge rubber 80 accommodated in an unmovable manner in the recess 10A from coming out of the recess 10A. Furthermore, the recess 10A is formed to surround the bearing mounting portion 10C of the main section 10. Thus, a sufficient space to accommodate the sponge rubber 80 can be secured.

The front end portion 61*a* of the first adjustment shaft 61 protrudes from the horizontal cap 12. Accordingly, by rotating the front end portion 61*a* of the first adjustment shaft 61, it is possible to easily change the position of the spring retaining member 40 in the axial direction and easily adjust the spring force of the return spring 50 from the outside of the main body housing 1. Especially, the front end portion 61*a* of the first adjustment shaft 61, which protrudes from the horizontal cap 12, can be operated as the operation section. Hence, an increase in size of the main body housing 1 can be prevented, and additionally, the operation of adjusting the spring force is easy.

The rolling element holding plate 70 is placed in the main body housing 1. When the front end portion 61*a* of the first adjustment shaft 61 is rotated, the flange portion 61*b* of the first adjustment shaft 61 rotates while rolling the plurality of needle rollers 73 held by the rolling element holding plate 70. The rolling element holding plate 70 can receive a load in the axial direction when the first adjustment shaft 61 is rotated. Thus, the rotation operation of the first adjustment shaft 61 does not require a large force. In addition, operability upon adjustment of the spring force is improved.

Moreover, the connecting rod is formed into a tube shape and the first adjustment shaft 61 and the second adjustment shaft 62 are inserted into the connecting rod. Accordingly, the movement of the operation section can be transmitted using an internal space of the connecting rod. Thus, the transmission section is formed without making the main body housing 1 thick in the vertical direction and wide in the horizontal direction. The pair of horizontal holes 63, which faces at 180 degrees, is formed in the connecting rod. The coordinating pin 60 protrudes from the horizontal holes 63 outwardly in the radial direction. Thus, it is possible to move the spring retaining member 40 smoothly and compress the return spring 50. In addition, the spring retaining member 40 moves in the axial direction without rotating. Thus, when the spring force of the return spring 50 is adjusted, rubbing noise does not occur between the return spring 50 and the spring retaining member 40. In the configuration where the spring retaining member 40 rotates together with the adjustment shaft, the spring retaining member 40 slides with respect to the return spring 50 while rotating in the circumferential direction. Accordingly, the rubbing noise occurs. In the configuration where the spring retaining member 40 moves in the axial direction, however, it is possible to prevent the rubbing noise from occurring between the spring retaining member 40 and the return spring 50. In addition, the adjustment can be made smoothly.

On the other hand, the piston 2 is located on the rear side of the spring retaining member 40, i.e., on the main shaft 3 side. In other words, the floor hinge is not configured such that the adjustment shaft penetrates the piston 2. Therefore, the spring force adjustment mechanism can be configured easily. The check valve 22 of the piston 2 can be also arranged easily. The length of the piston 2 in the axial direction can be prevented from becoming excessively long. The flow control channels 17 and 18 can be also arranged easily. Moreover, the floor hinge has an overlapping structure where the sliding plates 5 are inserted in the rear of the piston 2 by a predetermined length. Accordingly also in the configuration where the piston 2 is placed on the rear side of the spring retaining member 40, the total dimension of the main body housing 1 in the axial direction can be reduced.

The connecting rod has a tubular shape up to the rear end, and the check valve 22 is located inside the rear end. Accordingly, upon the door opening operation, the hydraulic oil that has moved from the communicating hole of the piston 2 to the second oil chamber 16 side can pass through the connecting rod. Furthermore, the hydraulic oil can also move easily from the horizontal holes 63 of the connecting rod to the outside of the connecting rod. Moreover, in the configuration where the check valve 22 is located outside the connecting rod, the piston 2 is increased in diameter. However, since the connecting rod is formed into a tube shape and the check valve 22 is placed inside the connecting rod, it is possible to prevent the size increase of the piston 2 and the main body housing 1.

The floor hinge according to the embodiment is configured such that the coordinating pin 60 penetrates the connecting rod vertically. However, the floor hinge may be configured such that the coordinating pin 60 penetrates the connecting rod horizontally. The direction may be any direction. However, in any case, the floor hinge is preferred to be configured such that the coordinating pin 60 penetrates the connecting rod in the radial direction. Moreover, the floor hinge may be configured such that the coordinating pin 60 is located on the rear side of the spring retaining member 40. However, as described above, the configuration where the coordinating pin 60 is inserted into the spring retaining member 40 from the radially inner side can reduce the dimension in the front and back direction, as compared to the configuration where the coordinating pin 60 is arranged on the rear side of the spring retaining member 40.

The heart-shaped cam 4 is used as the piston drive section. However, the floor hinge may be formed from a rack and pinion. However, in the case of the floor hinge, a large driving force is required. Therefore, the use of the cam 4 is preferable.

The check valve 22 is placed at the center of the piston 2. However, it may be placed outside the connecting rod. Moreover, the connecting rod has a tubular shape over its total length. However, the connecting rod may be solid in the rear and tubular only in the front. Moreover, the connecting rod and the piston 2 may be integrated as a single member. The floor hinge may be configured to form the main connecting rod 30 and the piston 2 as a single member and form the auxiliary connecting rod 31 as a separate member.

Furthermore, the floor hinge may be configured to place the piston 2 on the front side of the spring retaining member 40. In other words, the rear end surface of the piston 2 may serve as the spring retaining seat on the moving side, and the return spring 50 may be interposed between the piston 2 and the spring retaining member 40.

Moreover, the protruding portion of the adjustment shaft, which protrudes from the horizontal cap 12, functions as the operation section. However, the floor hinge may be configured such that the operation section is simply exposed without protruding from die horizontal cap 12. Although a rotation operation is preferred as an operation of the operation section, its operation is not limited to the rotation operation. For example, its operation may be an operation for moving the operation section in the axial direction.

Moreover, the recess 10A is formed in the main section 10 of the housing main body 1. However, the recess for accommodating the expansion absorption member may be formed in the upper cap 11.

Moreover, the pullout prevention means is the pin 82. However, a screw or the like may be used as the pullout prevention means.

The case of the floor hinge has been described. However, the door closer according to the embodiment is applicable to various door closers to be mounted on an upper part of or inside a door, or on a door frame.

DESCRIPTION OF REFERENCE NUMERALS

1 Main body housing
2 Piston
3 Main shaft
4 Cam (piston drive section)
4*a* Recess
5 Sliding plate
6 Roller
7 Roller
8 Pin
10 Main section
10A Recess
10B Cylindrical boss
10C Bearing mounting portion
11 Upper cap
12 Horizontal cap
12*a* Recess
13 Bearing
14 Bearing
15 First oil chamber
16 Second oil chamber
17 First flow control channel
18 Second flow control channel
20 Outer cylinder
21 Inner cylinder
22 Check valve
23 Valve seat
24 O-ring
25 Side hole (communicating hole)
26 Stopper pin
27 Inner path (communicating hole)
28 Spring
29 Safety valve
30 Main connecting rod (connecting rod)
31 Auxiliary connecting rod (connecting rod)
32 Flange portion
40 Spring retaining member
41 Stepped portion
42 Engagement recess
50 Return spring

60 Coordinating pin (coordinating member, transmission section)
60*a* Flat surface
61 First adjustment shaft (transmission section)
61*a* Front end portion (operation section)
61*b* Flange portion
62 Second adjustment shaft (transmission section)
62*a* Recess
63 Horizontal hole
70 Rolling element holding plate
70*a* Hole
70*b* Recess
71 Stepped portion
72 Cage
72*a* Hole
72*b* Pocket
73 Needle roller (rolling element)
80 Sponge rubber (expansion absorption member)
80A Through hole
81 Washer
82 Pin (pullout prevention means)

The invention claimed is:

1. A door closer including:

a main shaft that rotates upon a door opening/closing operation, a main body housing that pivotally supports the main shaft and includes an oil chamber filled with hydraulic oil, a piston that partitions the oil chamber into a first oil chamber on a side close to the main shaft and a second oil chamber on a side opposite to the main shaft, and moves toward the first oil chamber upon the door opening operation and moves toward the second oil chamber upon the door closing operation, a piston drive section that converts a rotation movement of the main shaft into a linear movement to drive the piston, and a return spring located on an identical line to the piston and interposed between a spring retaining seat on a fixed side close to the main shaft and a spring retaining seat on a moving side distant from the main shaft, the return spring storing a closing force upon being compressed by the spring retaining seat on the moving side moving closer to the spring retaining seat on the fixed side upon the door opening operation, the door closer comprising a spring force adjustment mechanism configured to change a position of a spring retaining member having the spring retaining seat on the fixed side in an axial direction of the piston with respect to the main body housing, and configured to adjust a spring force of the return spring by a change of the position of the spring retaining member through an operation from an outside of the main body housing, wherein the piston is located between the spring retaining member and the main shaft, the piston and the spring retaining seat on the moving side are connected by a connecting rod penetrating the spring retaining member, the connecting rod has a tubular portion opening at an end on the opposite side to the piston, and the spring force adjustment mechanism includes:

an operation section provided to an end of the main body housing on a side close to the second oil chamber; and a transmission section disposed between said operation section and said spring retaining member, the transmission section transmitting a movement of the operation section to the spring retaining member through an inside of the tubular portion of the connecting rod to move the spring retaining member in the axial direction of the piston.

2. The door closer according to claim 1, wherein a horizontal hole is formed in a peripheral wall of the tubular portion of the connecting rod, and the transmission section further includes:

an adjustment shaft that penetrates the end of the main body housing on the side close to the second oil chamber and is inserted through the tubular portion of the connecting rod; and a coordinating member that coordinates the adjustment shaft with the spring retaining member via the horizontal hole of the connecting rod.

3. The door closer according to claim 2, wherein the connecting rod has a tubular shape over a total length, a communicating hole with a check valve communicating between the first oil chamber and the second oil chamber is formed at a center of the piston, and the communicating hole is located inside an end of the connecting rod on a side close to the piston.

4. The door closer according to claim 1, wherein the connecting rod has a tubular shape over a total length, a communicating hole with a check valve communicating between the first oil chamber and the second oil chamber is formed at a center of the piston, and the communicating hole is located inside an end of the connecting rod on a side close to the piston.

5. The door closer according to claim 1, wherein the transmission section further includes:

a flange portion that is rotated by an operation of the operation section, and a rolling element holding plate that holds a plurality of rolling elements rolling by rotation of the flange portion is arranged in the main body housing.

6. The door closer according to claim 1, wherein a recess is formed in the main body housing, and an expansion absorption member is accommodated in the recess to come into contact with hydraulic oil in the first oil chamber.

7. The door closer according to claim 6, further comprising pullout prevention means that prevents the expansion absorption member from coming out of the recess.

* * * * *